US008084172B2

(12) United States Patent
Kurachi et al.

(10) Patent No.: US 8,084,172 B2
(45) Date of Patent: Dec. 27, 2011

(54) ORGANIC PHOTORECEPTOR, IMAGE FORMING APPARATUS, PROCESS CARTRIDGE, AND COLOR IMAGE FORMING APPARATUS

(75) Inventors: Masahiko Kurachi, Tokyo (JP); Hirofumi Hayata, Tokyo (JP); Toshiyuki Fujita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 357 days.

(21) Appl. No.: 12/433,982

(22) Filed: May 1, 2009

(65) Prior Publication Data

US 2009/0286175 A1 Nov. 19, 2009

(30) Foreign Application Priority Data

May 13, 2008 (JP) ..... 2008-125795

(51) Int. Cl.
*G03G 5/00* (2006.01)

(52) U.S. Cl. ..... 430/66; 430/132; 399/159

(58) Field of Classification Search ..... 430/66, 430/132; 399/159
See application file for complete search history.

(56) References Cited

U.S. PATENT DOCUMENTS

2007/0212627 A1* 9/2007 Yanagawa et al. ..... 430/58.75
* cited by examiner

*Primary Examiner* — Mark Chapman
(74) *Attorney, Agent, or Firm* — Lucas & Mercanti, LLP

(57) ABSTRACT

An organic photoreceptor comprising a photosensitive layer on a conductive substrate and a protective layer on the photosensitive layer, wherein the protective layer is a surface layer prepared via reaction curing of a compound having a radical polymerizable, curable functional group using a polymerization initiators and the content of the polymerization initiator detected in the photosensitive layer is at most 5,000 ppm.

11 Claims, 3 Drawing Sheets

ORGANIC PHOTORECEPTOR, IMAGE FORMING APPARATUS, PROCESS CARTRIDGE, AND COLOR IMAGE FORMING APPARATUS

This application is based on Japanese Patent Application No. 2008-125795 filed on May 13, 2008, in Japanese Patent Office, the entire content of which is hereby incorporated by reference.

TECHNICAL FIELD

The present invention relates to an organic photoreceptor (hereinafter also referred to simply as a photoreceptor) used in the field of copiers and printers, as well as an image forming apparatus, a process cartridge, and a color image forming apparatus utilizing the organic photoreceptor.

BACKGROUND

Conventionally, there has been frequently noted such a problem that thermoplastic resins used for an organic photoreceptor employed in electrophotographic image formation results in halftone nonuniformity due to surface scratches of the photoreceptor under an ambience of high temperature and humidity. As a method to solve this problem, improvements employing a photoreceptor provided with a protective layer have been attempted. Specifically, to increase surface hardness, there have also been conducted investigations on enhancement of strength of a protective layer via cross-linking reaction utilizing energy such as heat or light (Patent Document 1). In this manner, to enhance cross-link density by use of heat or light energy, there are various methods as described above, but from the viewpoint of the extent of cross-linking reaction, cross-linking reaction via light is suitable (Patent Document 2).

But cross-link density enhancement tends to easily impair potential characteristics. This reason has been thought to be that light energy required for cross-linking deteriorates the photosensitive layer.

However, in a cross-linking reaction system via light, when the amount of light to initiate curing reaction is decreased, the amount of generation of active species serving for the initiation point of the reaction is decreased, whereby photocuring inadequately proceeds, resulting in a protective layer with less strength. In contrast, with an excessive amount of light, curing adequately proceeds and then the strength of the protective layer is enhanced. However, excessive light also irradiates a photosensitive layer, which will be then deteriorated, resulting in insufficient potential stability over a print run of multiple sheets. Therefore, there has not always been compatibility of halftone nonuniformity due to surface scratches and potential stability over a print run of multiple sheets.

[Patent Document 1] Unexamined Japanese Patent Application Publication No. (hereinafter referred to as JP-A) 9-281736

[Patent Document 2] JP-A 2001-125297

SUMMARY

Disclosure of the Invention

Problems to be Solved by the Invention

The present invention is intended to solve the above problems. An object of the present invention is to provide an organic photoreceptor with compatibility of stable potential stability over a print run of multiple sheets and prevention of halftone nonuniformity via surface scratch prevention, wherein curing reaction of a protective layer is adequately allowed to proceed and deterioration of a photosensitive layer can be prevented.

Means to Solve the Problems

Accordingly, the present inventors conducted diligent investigations, and then found that in order to realize compatibility of strength via adequate hardening of a protective layer which is effective in surface scratch prevention and potential stability over a print run of multiple sheets, it was necessary that the amount of a polymerization initiator having diffused into a photosensitive layer was allowed to be relatively small, compared to the amount of a charge transporting material. Thus, the present invention was completed. Namely, the constitution of the present invention can be achieved by an organic photoreceptor having the following constitutions:

Item 1. An organic photoreceptor comprising a photosensitive layer on a conductive substrate and a protective layer on the photosensitive layer, wherein the protective layer is a surface layer prepared via reaction curing of a compound having a radical polymerizable, curable functional group using a polymerization initiator, and the content of the polymerization initiator detected in the photosensitive layer is at most 5,000 ppm.

Item 2. The organic photoreceptor described in Item 1 above, wherein the polymerization initiator has an α-aminoacetophenone structure.

Item 3. The organic photoreceptor described in Item 1 above, wherein the polymerization initiator has an α-hydroxyacetophenone structure.

Item 4. The organic photoreceptor described in Item 1 above, wherein the polymerization initiator has an acylphosphine oxide structure.

Item 5. The organic photoreceptor described in any one of Items 1-4 above, wherein an added amount of the polymerization initiator is 1/10-1/1,000 weight % based on the total weight of the compound having a radical polymerizable, curable functional group.

Item 6. The organic photoreceptor described in any one of Items 1-5 above, wherein a curable functional group of the compound having a radical polymerizable, curable functional group is an acryloyloxy group, a methacryloyloxy group, or an epoxy group.

Item 7. The organic photoreceptor described in any one of Items 1-6 above, wherein an alcohol-based solvent is employed as a coating solvent of the compound having radical polymerizable, curable functional group.

Item 8. The organic photoreceptor described in any one of Items 1-7 above, wherein in an infrared absorption spectrum of the protective layer, a ratio of a transmittance (Tac) of a peak present in the range of 1,610 $cm^{-1}$-1,640 $cm^{-1}$ to a transmittance (Tcb) of a peak present in the range of 1,700 $cm^{-1}$-1,800 $cm^{-1}$ satisfies following Expression 1;

$$0 \leqq Tac/Tcb \times 100 \leqq 10 \quad \text{(Expression 1)}$$

Item 9. An image forming apparatus having at least a charging member, an exposure member, and a developing member around the organic photoreceptor and carrying out repetitive image formation, wherein the organic photoreceptor is an organic photoreceptor having a photosensitive layer on a conductive substrate and a protective layer on the photosensitive layer; the protective layer is a surface layer prepared via reaction curing of a compound having a radical polymerizable, curable functional group using a polymerization initiator; and the content of the polymerization initiator detected in the photosensitive layer is at most.5,000 ppm.

Item 10. A process cartridge forming a cartridge by holding at least one of a charging member, a developing member, and a cleaning member together with an organic photoreceptor to form a single cartridge fully detachable to an image forming apparatus body, wherein the organic photoreceptor is an organic photoreceptor having a photosensitive layer on a conductive substrate and a protective layer on the photosensitive layer; the protective layer is a surface layer prepared via reaction curing of a compound having a radical polymerizable, curable functional group using a polymerization initiator; and the content of the polymerization initiator detected in the photosensitive layer is at most 5,000 ppm.

Item 11 A color image forming apparatus utilizing the organic photoreceptor described in any Items 1-8 above.

EFFECTS OF THE INVENTION

Using an organic photoreceptor having a protective layer prepared via reaction curing of a compound having a radical polymerizable/curable functional group using a polymerization initiator, the present invention made it possible to provide an organic photoreceptor with compatibility of stable potential stability over a print run of multiple sheets and prevention of halftone nonuniformity via surface scratch prevention, as well as a process cartridge and an image forming apparatus utilizing the organic photoreceptor.

DESCRIPTION OF THE PREFERRED EMBODIMENT

Figure 1:
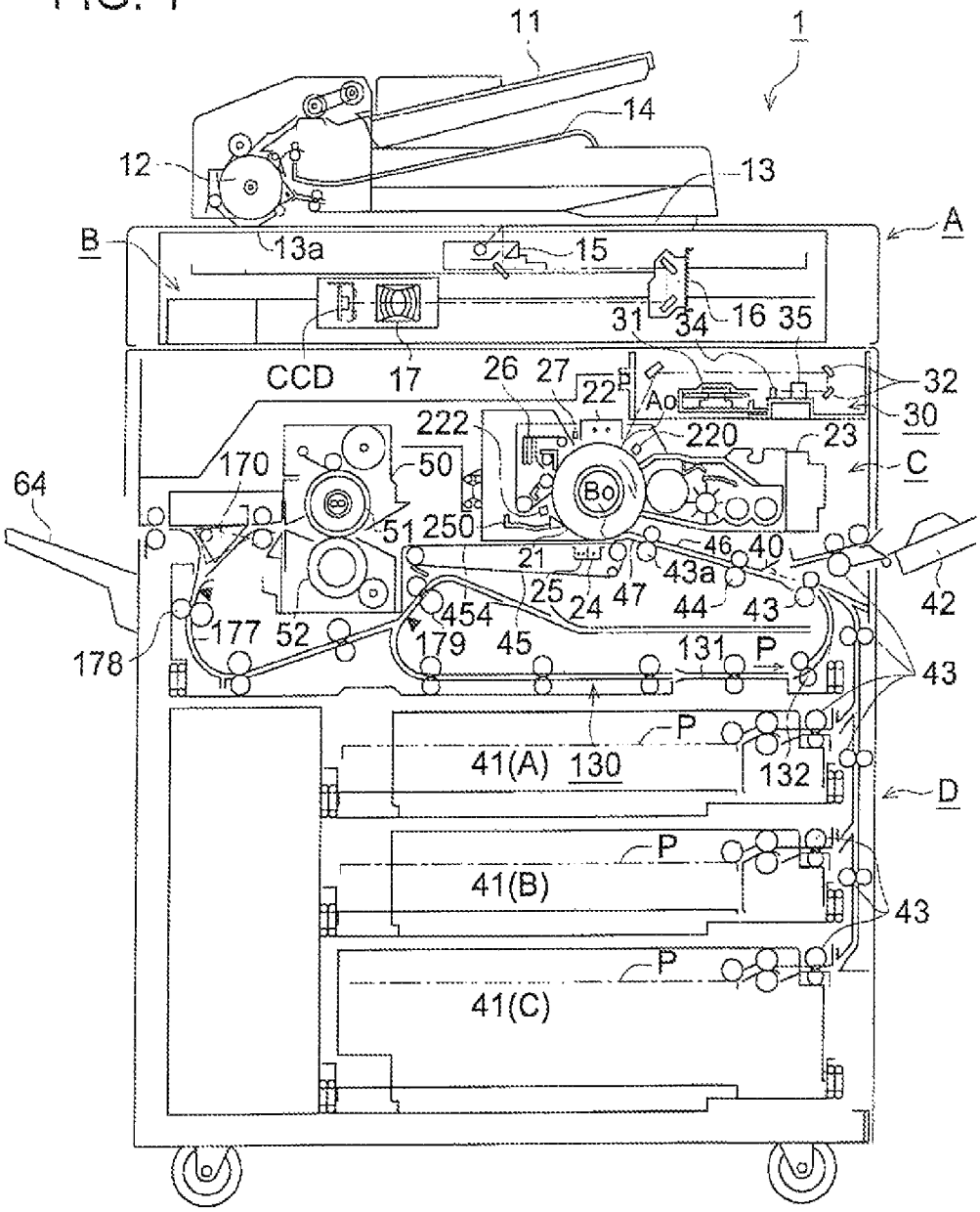
[FIG. 1] A schematic view incorporating the functions of the image/forming apparatus of the present invention

The organic photoreceptor of the present invention is an organic photoreceptor having a photosensitive layer on a conductive substrate and a protective layer on the photosensitive layer wherein the protective layer is a surface layer prepared via reaction curing of a compound having a radical polymerizable/curable functional group using a polymerization initiator and the content of the polymerization initiator detected in the photosensitive layer is at most 5,000 ppm.

When having the above constitutions, the organic photoreceptor of the present invention can realize compatibility of stable potential stability over a print run of multiple sheets and prevention of halftone nonuniformity via surface scratch prevention, as well as producing excellent electrophotographic images.

The constitutions of the organic photoreceptor show the following: in general, when a polymerization initiator for use in curing of a protective layer diffuses into an underlying photosensitive layer adjacent to the protective layer, charge trapping sites are formed in the photosensitive layer, resulting in deteriorated potential characteristics; therefore, according to the above constitutions, in order to prevent this phenomenon, the amount of the polymerization initiator diffusing into the photosensitive layer is controlled to be smaller.

The present invention will now be described sequentially.

Initially, a protective layer according to the present invention is described below.

In the present invention, a protective layer prepared via curing of a composition containing a compound having a radical polymerizable/curable functional group refers to a protective layer prepared by production and curing via polymerization reaction of a composition containing a compound having a radical polymerizable/curable functional group.

A compound having a radical polymerizable/curable functional group (hereinafter also referred to as a curable compound) will now be described.

The compound having a radical polymerizable/curable functional group refers to a compound wherein a radical group is produced by a catalyst function of a photopolymerization initiator or a polymerization initiator polymerization reaction is performed via chain reaction of the radical group; and then a polymerized substance, that is, a polymer or a cross-linked resin is produced.

As the above curable functional group, an acryloyloxy group ($CH_2{=}CHCOO{-}$), a methacryloyloxy group ($CH_2{=}C(CH_3)COO{-}$), and an epoxy group are listed.

These curable compounds as such may be used as a coating liquid component for a protective layer, or as a coating liquid component for the protective layer via polymerization previously forming an oligomer.

Examples of the curable compounds are listed below, but the present invention is not limited to these exemplified compounds.

| Exemplified Compound No. | Structural Formula | Ac Group Number |
|---|---|---|
| (1) | 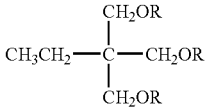 | 3 |
| (2) | 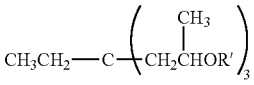 | 3 |

-continued
| Exemplified Compound No. | Structural Formula | Ac Group Number |
|---|---|---|
| (3) | 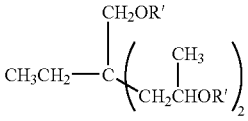 | 3 |
| (4) | 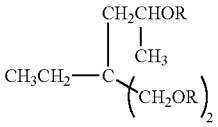 | 3 |
| (5) | 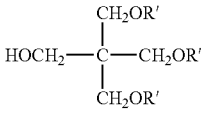 | 3 |
| (6) | 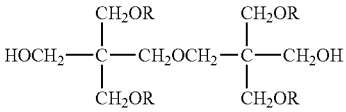 | 4 |
| (7) | 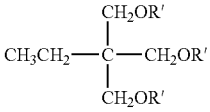 | 3 |
| (8) | 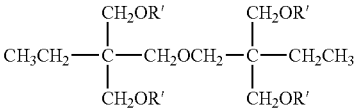 | 4 |
| (9) | 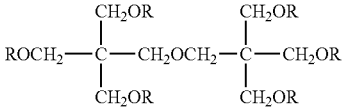 | 6 |
| (10) | 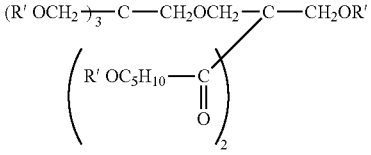 | 6 |
| (11) | 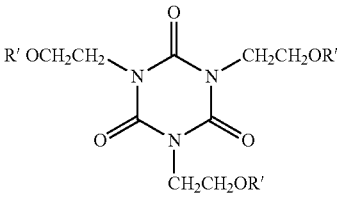 | 3 |
| (12) | $CH_3CH_2C{-}(CH_2OC_3H_6OR)_3$ | 3 |
| (13) | 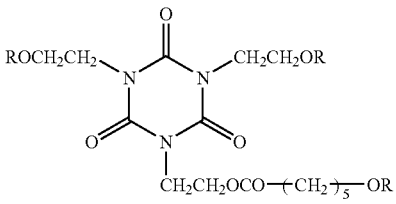 | 3 |

-continued
| Exemplified Compound No. | Structural Formula | Ac Group Number |
|---|---|---|
| (14) | $(ROCH_2)_3C-O-C(CH_2OR)_3$ | 6 |
| (15) | $(ROCH_2)_3C-CH_2OCH_2-C(H)(CH_2OR)_2$ | 5 |
| (16) | $(ROCH_2)_3C-CH_2OCH_2-C(CH_3)(CH_2OR)_2$ | 5 |
| (17) | $(ROCH_2)_3C-CH_2OCH_2-C(CH_2OH)(CH_2OR)_2$ | 5 |
| (18) | $(R'OCH_2)_3C-CH_2OCH_2-C(CH_2OR')(CH_2OH)_2$ | 4 |
| (19) | $(ROCH_2)_3C-O-C(CH_2OH)(CH_2OR)_2$ | 5 |
| (20) | 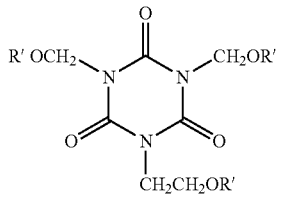 | 3 |
| (21) | $CH_3CH_2C(CH_2CH_2OR)_3$ | 3 |
| (22) | $HOCH_2-C(CH_2O-C(=O)CH_2CH_2CH_2CH_2CH_2OR)_3$ | 3 |
| (23) | 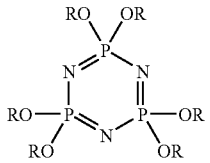 | 6 |
| (24) | 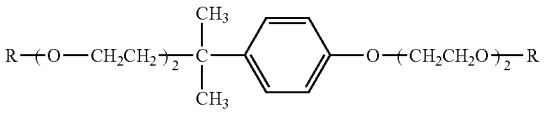 | 2 |
| (25) | 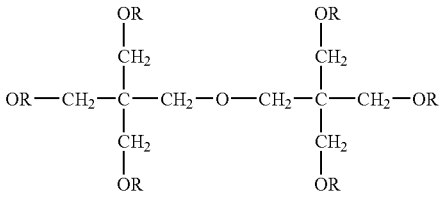 | 6 |
| (26) | 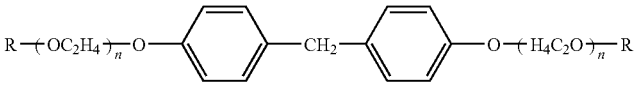 | 2 |
(n ≈ 2)

-continued
| Exemplified Compound No. | Structural Formula | Ac Group Number |
|---|---|---|
| (27) | 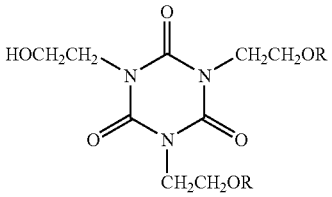 | 2 |
| (28) | $R-(OC_3H_6)_3-OR$ | 2 |
| (29) | 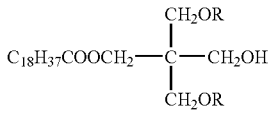 | 2 |
| (30) | 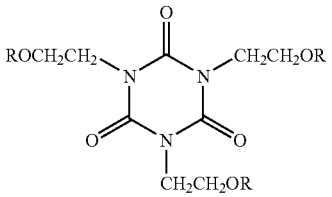 | 3 |
| (31) | $[R-(OC_3H_6)_n-OCH_2]_3-CCH_2CH_3$ (n ≈ 3) | 3 |
| (32) | 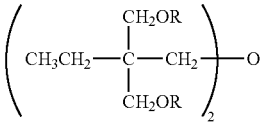 | 4 |
| (33) | $(ROCH_2)_4-C$ | 4 |
| (34) | $RO—C_6H_{12}—OR$ | 2 |
| (35) | 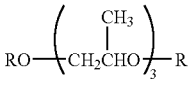 | 2 |
| (36) | 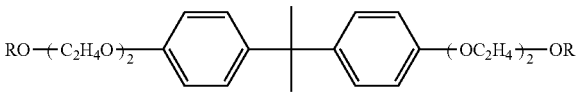 | 2 |
| (37) | 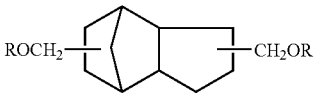 | 2 |
| (38) | $RO-(C_2H_4O)_9-R$ | 2 |
| (39) | 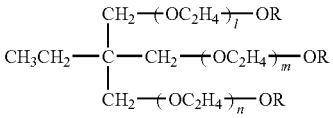 (l + m + n = 3) | 3 |

-continued

| Exemplified Compound No. | Structural Formula | Ac Group Number |
|---|---|---|
| (40) | $CH_3CH_2-C(CH_2-(OCOC_5H_{12})_l-OR)(CH_2-(OCOC_5H_{12})_m-OR)(CH_2-(OCOC_5H_{12})_n-OR)$ <br> (l + m + n = 3) | 3 |
| (41) | $RO(CH_2)_2OCONHCH_2-C(CH_3)_2-CH_2CH(CH_2)_2NHCOO(CH_2)_2OR$ <br> $RO(CH_2)_2OCONHCH_2CH(CH_3)CH_2-C(CH_3)_2-(CH_2)_2NHCOO(CH_2)_2OR$ <br> a mixture of and | 2 |
| (42) | $(ROCH_2)_3CCH_2OCONH(CH_2)_6NHCOOCH_2C(CH_2OR)_3$ | 6 |

Herein, R and R' of exemplified compounds (1)-(42) represent the following groups, respectively

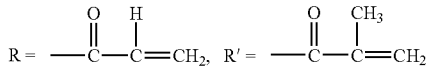

These curable compounds as described above are available on the market and can be purchased from such companies as Nihon Kayaku Co., Ltd., Toagosei Co., Ltd., and Daicel-Cytec Co., Ltd. Further, the Ac group number of the curable compounds represents the number of functional groups. A functional group of any of the curable compounds is preferably at least two-functional. To realize a networked resin structure, an at least three-functional compound is preferably mixed.

As polymerization initiators for the curable compounds, photopolymerization initiators are preferable. Of these, alkylphenone compounds or phosphine oxide compounds are preferable. Compounds having an α-hydroxyacetophenone structure or an acylphosphine oxide structure are specifically preferable. Since such photopolymerization initiators rapidly induce photopolymerization-initiated reaction and exhibit enhanced reaction efficiency, these initiators are consumed by reaction in a protective layer and the amount of diffusion into an underlying photosensitive layer is decreased. The amount of any of the polymerization initiators is preferably 1/10-1/1000% by mass based on the amount of a curable compound.

Compound examples of the photopolymerization initiators used in the present invention will now be listed. Examples of α-aminoacetophenone based compounds:

Polymerization initiator 1-1

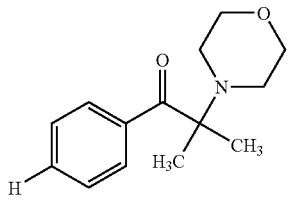

Polymerization initiator 1-2

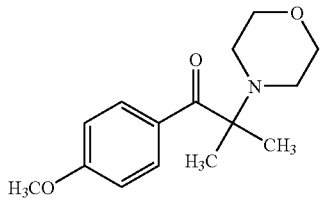

Polymerization initiator 1-3

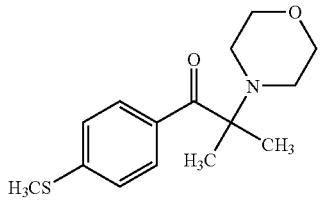

Polymerization initiator 1-4

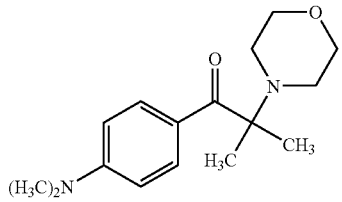

-continued

Polymerization initiator 1-5

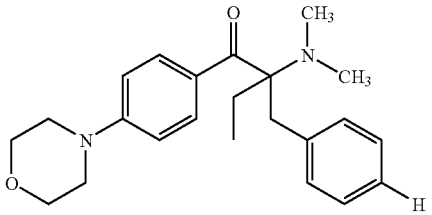

Polymerization initiator 1-6

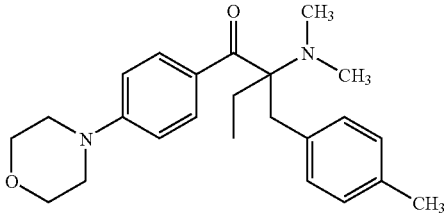

Examples of α-hydroxyacetophenone based compounds:

Polymerization initiator 2-1

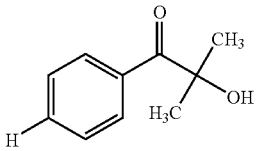

Polymerization initiator 2-2

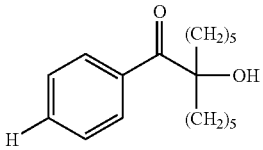

Polymerization initiator 2-3

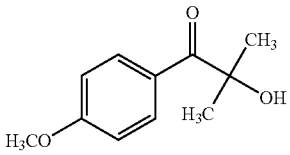

Polymerization initiator 2-4

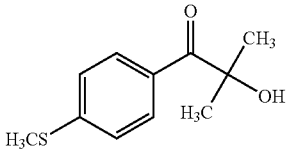

Polymerizaion initiator 2-5

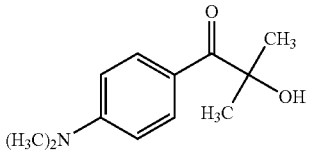

Polymerization initiator 2-6

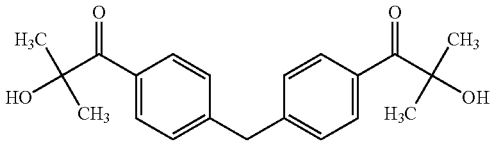

Examples of acylphosphine oxide based compounds:

Polymerization initiator 3-1

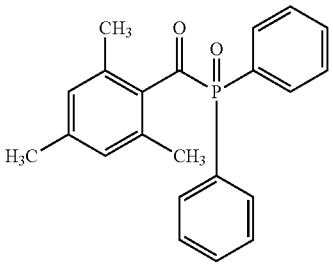

Polymerization initiator 3-2

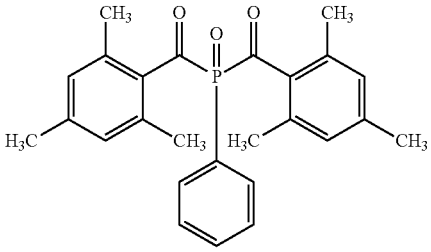

To form a protective layer, a production method is preferably used wherein a protective layer coating liquid (the above composition) is coated on a photosensitive layer, and then primary drying is carried out to the extent that the coated film exhibits no fluidity, followed by curing of the protective layer via UV irradiation to carry out secondary drying to adjust the amount of volatile substances in the coated film to be a specified amount.

AS apparatuses for UV irradiation, any appropriate apparatuses known in the art used for curing of UV curable resins are employable.

The amount (mJ/cm$^2$) of UV radiation for use in UV curing of a resin is preferably controlled by UV irradiation intensity and irradiation duration.

To realize a content of at most 5,000 ppm of the above polymerization initiator detected in a photosensitive layer according to the present invention, it is important to use a photopolymerization initiator exhibiting excellent reactivity as described above and also to select a coating solvent for a protective layer coating liquid. As the coating solvents, preferable coating solvents which dissolve a curable compound but tend not to dissolve a binder resin such as a polycarbonate used in an underlying photosensitive layer. Of these, alcohol-based solvents are preferable. Specifically, there are listed n-butyl alcohol, isopropyl alcohol, ethyl alcohol, and methyl alcohol.

Further, with regard to a coating method of a protective layer, immersion coating, in which a photoreceptor is entirely immersed in a protective layer coating liquid, increases the diffusion of a polymerization initiator into an underlying layer. Therefore, to allow the film of a photosensitive layer under the protective layer to be dissolved as little as possible it is preferable to use a coating process method such as amount regulation type (a typical example thereof is a circular slide hopper type) coating. The above circular amount regulation type coating is detailed, for example, in JP-A 58-189061.

The film thickness of the protective layer of the present invention is 0.5-15 μm, preferably 1-10 μm.

Further, the protective layer may contain an antioxidant. The content of the antioxidant is preferably 0.5-10% by mass based on 100% by mass of the above curable compound.

Still further, the protective layer preferably contains metal oxides. The hardness of the protective layer can be further enhanced by containing metal oxides, and then friction of the photoreceptor can be reduced.

Such metal oxides (metal oxide particles) include silicon oxides of transition metals. For example, there can be preferably used fine particles such as silica, zinc oxide, titanium oxide, alumina, tin oxide, antimony oxide, indium oxide, bismuth oxide, tin-doped indium oxide, antimony- or tantalum-doped tin oxide, or zirconium oxide. Of these, specifically, silica, titanium oxide, and alumina (aluminum oxide) are preferable in view of cost and ease of particle diameter adjustment and surface treatment.

Further, the size of any of these metal oxide particles is preferably 10-100 nm in terms of number average primary particle diameter.

The number average primary particle diameter of metal oxide particles is determined as follows: randomly selected 300 particles are observed as primary particles via transmission electron microscope observation at a magnification of 10,000, and then a measurement value is calculated as the number average diameter in terms of Fere diameter via image analysis.

Further, to adjust the moisture absorption ratio of metal oxide particles in the range of 0.1-10%, the surface of these metal oxide particles is preferably hydrophobized.

As hydrophobizing agents, commonly known compounds are usable, and specific examples thereof are listed below. Herein, these compounds may be used in combination.

Titanium coupling agents include tetrabutyl titanate, tetraoctyl titanate, isopropyl triisostearoyl titanate, isopropyl tridecylbenzenesulfonyl titanate, and bis(dioctyl pyrophosphate)oxyacetate titanate.

Silane coupling agents include γ-(2-aminoethyl)aminopropyl trimethoxy silane, γ-(2-aminoethyl)aminopropyl methyl dimethoxy silane, γ-methacryloxypropyl trimethoxy silane, N-β-vinylbenzylaminoethyl-N-γ-aminopropyl trimethoxy silane hydrochloride, hexamethyl disilazane, methyl trimethoxy silane, butyl trimethoxy silane, isobutyl trimethoxy silane, hexyl trimethoxy silane, octyl trimethoxy silane, decyl trimethoxy silane, dodecyl trimethoxy silane, phenyl trimethoxy silane, o-methylphenyl trimethoxy silane, and p-methylphenyl trimethoxy silane.

As silicone oil, listed are dimethyl silicone oil, methylphenyl silicone oil, and amino-modified silicone oil.

Further, as the above surface hydrophobizing agent, hydrogen polysiloxane compounds may be used. As the hydrogen polysiloxane compounds, those having a molecular weight of 1,000-20,000 are easily available. Especially, use of methyl hydrogen polysiloxane for a final surface treatment makes it possible to produce excellent effects.

Any of these hydrophobizing agents is coated preferably by addition of 1-40% by mass, more preferably 3-30% by mass, based on the amount of metal oxide particles.

Hydrophobization treatment of metal oxide particles is carried out via any of the conventionally known methods such as a dry method wherein metal oxide particles, having been dispersed in a cloud form by stirring, are sprayed with a solution of a hydrophobizing agent dissolved in alcohol, or a vaporized hydrophobizing agent is allowed to be in contact with metal oxide particles for adhesion; or a wet method wherein metal oxide particles are dispersed in a solution and therein a hydrophobizing agent is dripped for adhesion.

Further, the content of metal oxide particles used in a protective layer is 10-150% by mass, preferably 20-100% by mass, based on 100% by mass of a compound having a radical polymerizable/curable functional group for used in the protective layer. In the case of more than 150% by mass, image density tends to decrease and image deletion tends to occur. On the other hand, in the case of less than 10% by mass, the residual potential tends to increase and film hardness tends to decrease.

The structure of an organic photoreceptor applied to the present invention, except for a protective layer, will now be described.

In the present invention, an organic photoreceptor refers to an electrophotographic photoreceptor constituted by allowing an organic compound to have at least one of a charge generating function and a charge transporting function essential for the structure of the electrophotographic photoreceptor, including all the organic photoreceptors known in the art such as a photoreceptor constituted of a known organic charge generating material or organic charge transporting material or a photoreceptor constituted of a polymer complex exhibiting a charge generating function and a charge transporting function.

With regard to the layer structure of the organic photoreceptor of the present invention, for example, the following layer structures are listed.

1) A structure wherein a charge generating layer and a charge transporting layer are sequentially laminated, as photosensitive layers, on a conductive support 2) A structure wherein a charge generating layer, a first charge transporting layer, and a second charge transporting layer are sequentially laminated, as photosensitive layers, on a conductive support The above photosensitive layer structures are cited as examples. However, the photoreceptor of the present invention is constituted via formation of a surface protective layer, as described above, on the above photosensitive layers.

The photoreceptor may have either of the above structures. Further, whichever structure the photoreceptor of the present invention has, a sublayer (an intermediate layer) may be formed prior to photosensitive layer formation on a conductive support.

A charge transporting layer refers to a layer having a function in which charge carriers generated in a charge generating layer via light exposure are transported on the surface of an organic photoreceptor. Specific detection of the charge transporting function can be confirmed by detection of photoconductivity wherein a charge generating layer and a charge transporting layer are laminated on a conductive support.

Next, with regard to the layer structure of an organic photoreceptor, a specific constitution of a photoreceptor used in the present invention will now be described, mainly based on the structure of 1).

Conductive Support

As a conductive support used for the photoreceptor of the present invention, a sheet or cylindrical conductive support is used.

The cylindrical conductive support of the present invention refers to a cylindrical support which is needed to form images in an endless manner via rotation thereof. Preferable is a conductive support featuring a straightness of at most 0.1 mm and a deflection of at most 0.1 mm. In the case of exceeding these ranges of straightness, and deflection, excellent image formation is difficult to realize.

As materials of the conductive support, there can be used a metal drum such as aluminum or nickel, a plastic drum deposited with aluminum, tin oxide, or indium oxide, or a paper or plastic drum coated with a conductive substance. The conductive support preferably has a specific resistance of at most $10^3$ Ωcm at normal temperature.

As a conductive support used in the present invention, those on the surface of which an alumite layer, having been subjected to sealing treatment, is formed may be used. Alumite treatment is commonly carried out in an acid bath such as chromic acid, sulfuric acid, oxalic acid, phosphoric acid, boric acid, or sulfamic acid. Of these, anodization treatment in sulfuric acid produces the most preferable result. The anodization treatment in sulfuric acid is preferably carried out at a sulfuric acid concentration of 100-200 g/l, an aluminum ion concentration of 1-10 g/l, a liquid temperature of about 20° C., and an applied voltage of about 20 V. However, these conditions are not limited. Further, the average film thickness of an anodized coated film is commonly at most 20 μm, specifically preferably at most 10 μm.

Intermediate Layer

In the present invention, an intermediate layer with a barrier function as described above is preferably arranged between a conductive support and a photosensitive layer.

In the intermediate layer of the present invention, titanium oxide is preferably contained in a binder resin exhibiting a relatively small moisture absorption ratio. The average particle diameter of such titanium oxide particles is commonly in the range of 10 nm-400 nm, preferably 15 nm-200 nm, in terms of number average primary particle diameter. In the case of less than 10 nm, the intermediate layer produces a poor preventing effect for moire occurrence. In contrast, in the case of more than 400 nm, titanium oxide particles in an intermediate layer coating liquid tend to be precipitated, whereby uniform dispersibility of the titanium oxide particles in the intermediate layer tends to be poorly realized and also black spots are likely to be increased. An intermediate layer coating liquid, employing titanium oxide particles featuring a number average primary particle diameter of the above range, exhibits excellent dispersion stability, and furthermore, an intermediate layer formed using such a coating liquid exhibits a black spot preventing function and favorable environmental properties, as well as cracking resistance.

Shapes of titanium oxide particles used in the present invention include shapes such as dendritic, needle, and granular ones. With regard to titanium oxide particles of such shapes, for example, in titanium oxide particles, there are an anatase type, a rutile type, and an amorphous type as crystal types. Those having any of these crystal types may be used, and at least 2 kinds of the crystal types may be used in combination. Of these, those, which are of a rutile type and granular, are most preferable.

The titanium oxide particles of the present invention are preferably surface treated. One of the surface treatments is carried out in such a manner that surface treatments of multiple times are conducted, and of the surface treatments of multiple times, a final surface treatment is a surface treatment using a reactive organic silicon compound. Further, of the surface treatments of multiple times, it is preferable that at least one surface treatment be a surface treatment using at least one selected from alumina, silica, and zirconia, and preferable that a surface treatment using a reactive organic silicon compound be conducted last.

Herein, alumina treatment, silica treatment, or zirconia treatment refers to treatment to allow alumina, silica, or zirconia to be deposited on the surface of titanium oxide particles. Such alumina, silica, or zirconia deposited on the surface includes a hydrate of alumina, silica, or zirconia. Further, the surface treatment with a reactive organic silicon compound refers to the use of a reactive organic silicon compound for a treatment solution.

In such a manner as for titanium oxide particles, the surface of titanium oxide particles is uniformly subjected to surface coating (treatment) by conducting surface treatments of the titanium oxide particles at least twice. Thus, when the surface treated titanium oxide particles are used in an intermediate layer, there can be obtained an excellent photoreceptor exhibiting enhanced titanium oxide particle dispersibility with respect to titanium oxide particles in the intermediated layer, as well as causing no image defects such as black spots.

The above reactive organic silicon compound includes compounds represented by following Formula (1). However, such compounds as-described below are not limited, provided that these compounds perform condensation reaction with a reactive group such as a hydroxyl group on the titanium oxide surface.

$$(R)_n—Si—(X)_{4-n}$$ Formula (1):

wherein Si represents a silicon atom; R represents an organic group with a carbon atom directly joining the silicon atom; X represents a hydrolyzable group; and n represents an integer of 0-3.

In organic silicon compounds represented by Formula (1), as the organic group with a carbon atom directly joining the silicon atom, represented by R, there are listed an alkyl group such as a methyl, ethyl, propyl, butyl, pentyl, hexyl, octyl, or dodecyl group; an aryl group such as a phenyl, tolyl, naphthyl, or biphenyl group; an epoxy-containing group such as a γ-glycidoxypropyl or β-(3,4-epoxycyclohexyl)ethyl group; a (meth)acryloyl-containing group such as a γ-acryloxypropyl or γ-methacryloxypropy group; a hydroxy-containing group such as a γ-hydroxypropyl or 2,3-dihydroxypropyloxypropyl group; a vinyl-containing group such as a vinyl or propenyl group; a mercapto-containing group such as a γ-mercaptopropyl group; an amino-containing group such as a γ-aminopropyl or N-β(aminoethyl)-γ-aminopropyl group; a halogen-containing group such as a γ-chloropropyl 1,1,1-trifluoropropyl, nonafluorohexyl, or perfluorooctylethyl group; and a nitro- or cyano-substituted alkyl group. Further, examples of the hydrolyzable group of X include an alkoxy group such as a methoxy or ethoxy group, a halogen group, and an acyloxy group.

Further, the organic silicon compounds represented by Formula (1) may be used individually or in combination of at least 2 types.

Still further, in specific compounds of the organic silicon compounds represented by Formula (1), when n is at least 2, a plurality of R's may be the same or differ. Similarly, when n is at most 2, a plurality of X's may be the same or differ. And, when at least 2 types of the organic silicon compounds represented by Formula (1) are used, R's and X's each may be the same or differ among these compounds.

Yet further, as preferable reactive organic silicon compounds used for surface treatment, polysiloxane compounds are exemplified. As the polysiloxane compounds, those having a molecular weight of 1,000-20,000 are easily available, and also exhibit an excellent black spot preventing function.

When methyl hydrogen polysiloxane is used in a final surface treatment, favorable effects can be produced.

Photosensitive Layers

Charge Generating Layer

A charge generating material (CGM) is Incorporated in a charge generating layer. As other materials a binder resin and other additives may be incorporated, as appropriate.

In the organic photoreceptor of the present invention, for example, a phthalocyanine pigment, an azo pigment, a perylene pigment, and an azulenium pigment can be used individually or in combination as a charge generating material.

When a binder is used as a dispersion medium for a CGM in a charge generating layer, any commonly known resins may be used as the binder. However, the most preferable resins include a formal resin, a butyral resin, a silicone resin, a silicone-modified butyral resin, and a phenoxy resin. The ratio of the charge generating material to the binder resin is preferably 20-600 parts by mass based on 100 parts by mass of the binder resin. Use of such a resin makes it possible to minimize the increase of the residual potential resulting from repetitive use. The film thickness of the charge generating layer is preferably 0.1 μm-2 μm.

Charge Transporting Layer

A charge transporting material (CTM) and a binder resin to disperse the CTM for film production are incorporated in a charge transporting layer. As other materials, additives such as an antioxidant may be incorporated, as appropriate.

As the charge transporting material (CTM), a charge transporting material having an atomic weight ratio of an N atom of less than 4.5% as described above is used. As the fundamental structure of the charge transporting material there can be used a triphenylamine derivative, a styryl compound, a benzidine compound, and a butadiene compound. Of these, a styryl compound is preferable. Specific compound examples of the charge transporting material include the following compound examples.

CTM-1

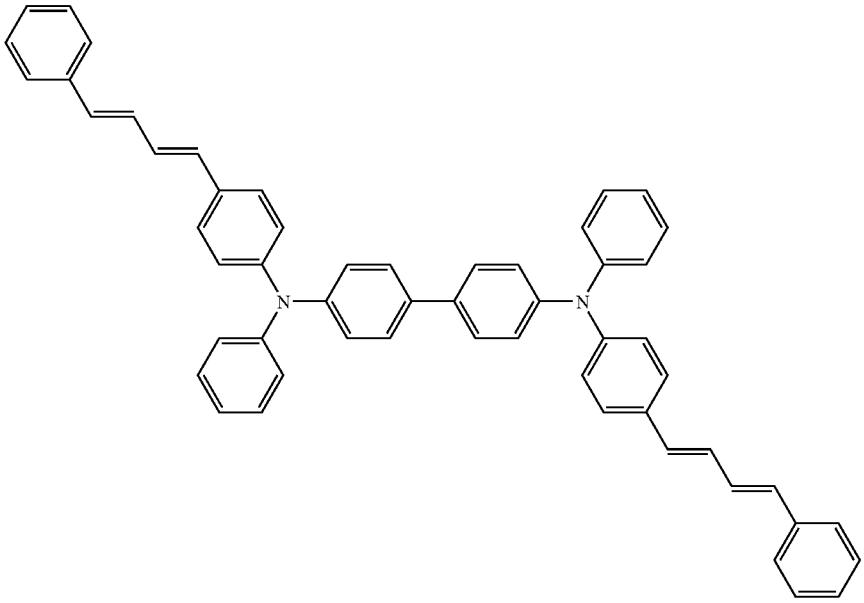

CTM-2

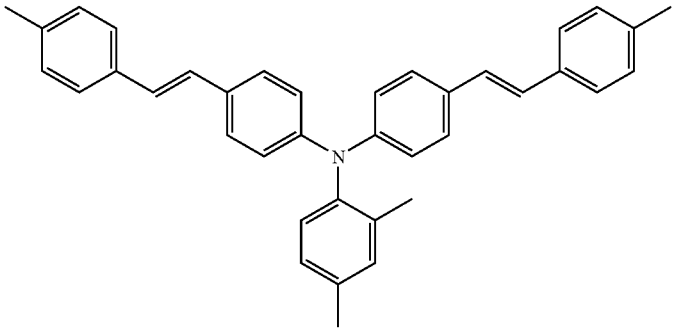

-continued
CTM-3
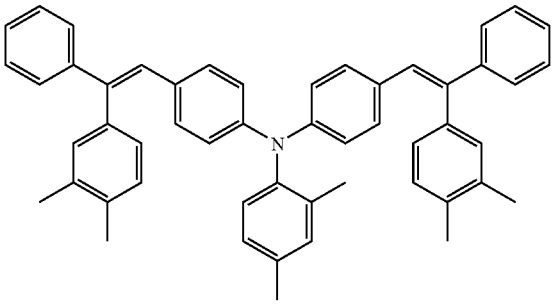
CTM-4
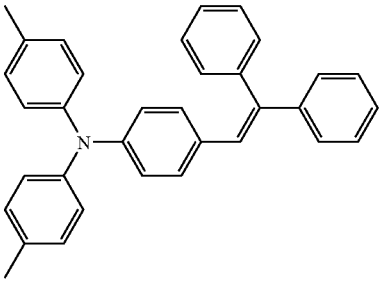
CTM-5
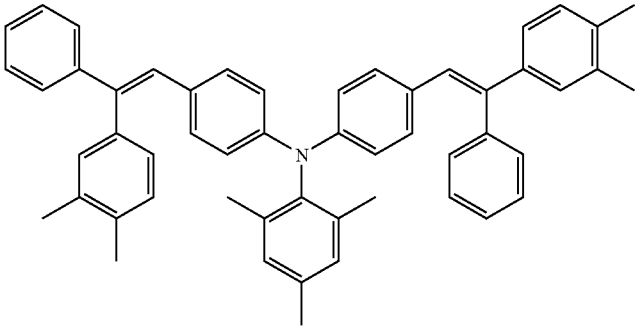
CTM-6
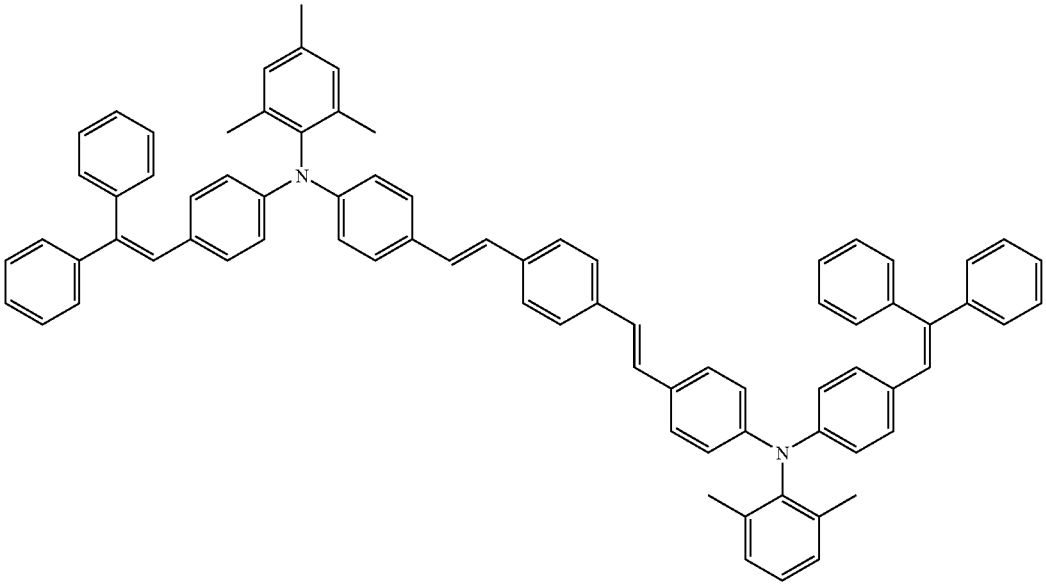
CTM-7
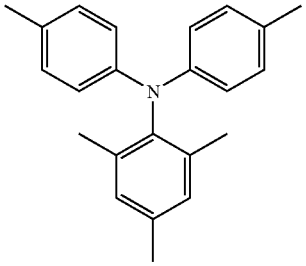
CTM-8
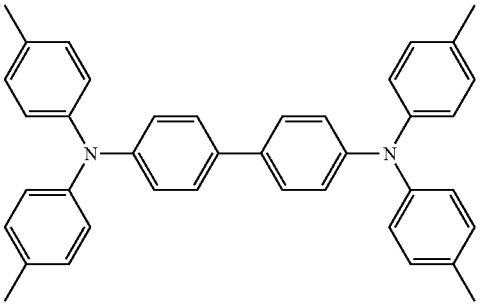

-continued

CTM-9

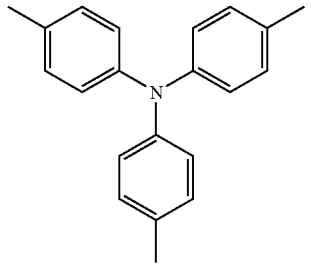

Further, a charge transporting material having an atomic weight ratio of an N atom of less than 4.5% may be used together with a charge transporting material having an atomic weight ratio of an N atom of at least 4.5%. In cases of use in combinations, the amount of the charge transporting material having an atomic weight ratio of an N atom of at least 4.5% is preferably at most 40% by mass, based on the total amount of the charge transporting materials.

Herein, the atomic weight ratio of an N atom refers to the percentage by mass of an N atom with respect to the molecular weight (the molecular weight in terms of mass) of a charge transporting material.

These charge transporting materials are commonly dissolved in an appropriate binder resin for layer formation.

As binder resins used for a charge transporting layer (CTL), any thermoplastic resin and thermosetting resin are exemplified, including, for example, polystyrene, an acrylic resin, a methacrylic resin, a vinyl chloride resin, a vinyl acetate resin, a polyvinyl butyral resin, an epoxy resin, a polyurethane resin, a phenol rein, a polyester resin, an alkyd resin, a polycarbonate resin, a silicone resin, a melamine resin, and a copolymer resin having at least 2 repeating unit structures of these resins. In addition to these insulating resins, polymer organic semiconductors such as poly-N-vinyl carbazole are also exemplified. Of these, a polycarbonate resin is most preferable in view of less moisture absorption ratio, enhanced CTM dispersibility, and excellent electrophotographic characteristics.

The ratio of the charge transporting material to the binder resin is preferably 50-200 parts by mass based on 100 parts by mass of the binder resin.

Further, the total film thickness of the charge transporting layer (at least 1 layer, but preferably 1-3 layers) is preferably 5-25 μm. When the film thickness is less than 5 μm, inadequate charge potential tends to result. In the case of more than 25 μm, sharpness is likely to decrease.

Examples of solvents or dispersion media used in layer formation of an intermediate layer, a charge generating layer, and a charge transporting layer include n-butylamine, diethylamine, ethylenediamine, isopropanolamine, triethanolamine, triethylene diamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethylsulfoxide, and methyl cellosolve. The present invention is not limited thereto, but dichloromethane, 1,2-dichloroethane, and methyl ethyl ketone are preferably used. These solvents can also be used individually or as a mixed solvent of at least 2 kinds thereof.

As a coating process method to produce an organic photoreceptor, used is a coating process method such as immersion coating, spray coating, or circular amount regulation type coating. In coating processing on the upper layer side of a photosensitive layer, in order for the film of a lower layer to be dissolved as little as possible and also to realize uniform coating processing, it is preferable to use a coating process method such as spray coating or circular amount regulation type (a typical example thereof is a circular slide hopper type) coating. Herein, the above circular amount regulation type coating process method is most preferably used for the protective layer. The circular amount regulation type coating is detailed, for example, in JP-A 58-189061.

A determination method of a polymerization initiator in a photosensitive layer according to the present invention will now be described.

The content of the polymerization initiator of a photosensitive layer refers to the content of a polymerization initiator in the residual photosensitive layer obtained by removing a protective layer of the surface from the photoreceptor of the present invention (the support is removed, but an intermediate layer is included).

According to this detection method, the content (ppm) of a polymerization initiator detected in a photosensitive layer according to the present invention can be calculated, wherein a protective layer is peeled or scraped away from an organic photoreceptor and then all of the residual layers are peeled from the support; and then the mass of the polymerization initiator extracted from all of the residual layers is divided by the mass of all of the peeled residual layers (including the photosensitive layer and an intermediate layer), followed by conversion into the unit of ppm.

Herein, extraction of the polymerization initiator and determination of its mass were carried out under the following conditions.

Extraction solvent: a mixed solvent of methanol/tetrahydrofuran (3/1)

Determination Conditions

High-performance liquid chromatography

Instrument: Shimadzu LC6A (produced by Shimadzu Corp.)

Column: CLC-ODS (produced by Shimadzu Corp.)

Mobile phase: methanol/tetrahydrofuran (3/1)

Mobile phase flow rate: about 1 ml/minute

Detection wavelength: 290 nm

In determination using the above high-performance liquid chromatography, a calibration curve for the detected amount of a polymerization initiator, being a subject to be determined, is prepared in advance, followed by comparison of a detected value as the measurement result to the above calibration curve to calculate the mass of the polymerization initiator.

Further, in the infrared absorption spectrum of the above protective layer, it is preferable that Expression 1 described above be satisfied by the ratio of the transmittance (Tac) of a peak present in the range of 1610 $cm^{-1}$-1640 $cm^{-1}$: the peak characteristic of an acryloyl group to the transmittance (Tcb) of a peak present in the range of 1700 $cm^{-1}$-1800 $cm^{-1}$: the peak characteristic of a carbonyl group.

Namely, a smaller value of following Expression 1 indicates that hardening of a protective layer proceeds. When a protective layer according to the present invention satisfies the relationship as represented by Expression 1, the effects of the present invention tend to be exhibited more positively.

$$0 \leqq Tac/Tcb \times 100 \leqq 10 \quad \text{(Expression 1)}$$

With regard to sample preparation for the infrared absorption spectrum of a protective layer and a determination method for a sample to be determined, the protective layer, together with a photosensitive layer, is peeled from the support of a photoreceptor, being a subject to be determined, and then using the thus-peeled sample, determination is carried out with the following instrument:

Infrared absorption spectrum instrument FT-IR (Model 5SX, produced by Nicolet Analytical Instruments Corp.)

Next, an image forming apparatus utilizing the organic photoreceptor of the present invention is described below.

Image forming apparatus 1 shown in FIG. 1 is a digital mode image forming apparatus, which is constituted of image reading section A, image processing section B, image forming section C, and transfer paper conveying section D as a transfer paper conveying member.

An automatic document feeding member to automatically convey original documents is arranged in the upper part of image reading section A. Original documents mounted on document stacking table 11 are conveyed, while being separated sheet by sheet by document conveying roller 12, to carry out image reading at reading position 13*a*. An original document, having been subjected to document reading, is discharged onto document discharging tray 14 by document conveying roller 12.

On the other hand, the image of an original document placed on platen glass 13 is read by reading operation at a rate of v of first mirror unit 15 composed of an illuminating lamp and a first mirror constituting an optical scanning system and by movement at a rate of v/2 in the same direction of second mirror unit 16 composed of a second mirror and a third mirror which are positioned in a V letter shape.

The read image is focused through projection lens 17 onto the light receiving surface of a CCD image sensor which is a line sensor. The linear optical image, which has been focused onto the CCD image sensor, is successively subjected to photoelectric conversion into electric signals (brightness signals), and then is subjected to A/D conversion. The resulting signals are subjected to various processes such as density conversion and filtering processing in image processing section B, and thereafter, the resulting image data are temporarily stored in a memory.

In image forming section C, there are arranged, as an image forming unit, drum-shaped photoreceptor 21 which is an image carrier, and on the outer circumference thereof, charging member (charging process) 22 charging above photoreceptor 21, potential detecting member 220 detecting the surface potential of the charged photoreceptor, developing member (developing process) 23, transfer. conveyance belt unit 45 as a transferring member (transferring process), cleaning unit (cleaning process) 26 of above photoreceptor 21, and PCL (pre-charge lamp) 27 as a light discharging member (light discharging process) in the order of each movement. Further, reflective density detecting member 222, measuring the reflective density of a patch image developed on photoreceptor 21, is provided on the downstream side of developing member 23. An organic photoreceptor according to the present invention is used as photoreceptor 21, and is rotationally driven clockwise as shown in the drawing.

Rotating photoreceptor 21 is uniformly charged by charging member 22, and image exposure is carried out based on image signals read out by an optical exposure system as image exposure member (image exposure process) 30 from the memory in image processing section B. The optical exposure system as image exposure member 30, which is a writing member, employs a laser diode as a light emitting source, although being not shown in the drawing, and primary scanning is performed by the light pass bent by reflection mirror 32 via rotating polygon mirror 31, fθ lens 34, and cylindrical lens 35, whereby photoreceptor 21 is subjected to image exposure at the position of Ao to form an electrostatic latent image via rotation (secondary scanning) of photoreceptor 21. In an example of the embodiments of the present invention, an electrostatic latent image is formed via exposure to a letter portion.

In the image forming apparatus of the present invention, when an electrostatic latent image is formed on a photoreceptor, a semiconductor laser or a light-emitting diode of an oscillation wavelength of 350-800 nm is preferably used as an image exposure light source. Using such an image exposure light source, the exposure dot diameter in the primary scanning direction of writing is narrowed to 10-100 μm, and digital exposure is performed on an organic photoreceptor to obtain an electrophotographic image at a high resolution of 400 dpi (dpi: the number of dots per 2.54 cm)-2,500 dpi.

The above exposure dot diameter refers to an exposure beam length (Ld: the maximum length is measured) in the primary scanning direction in an area in which the intensity of the exposure beam is at least $1/e^2$ of the peak intensity.

Light beams used include a scanning optical system employing a semiconductor laser and an LED solid scanner. Light intensity distribution includes Gaussian distribution and Lorentz distribution, and an area having a peak intensity of at least $1/e^2$ is designated as the exposure dot diameter of the present invention.

An electrostatic latent image on photoreceptor 21 is reversely developed by developing member 23 to form a toner image, being a visual image, on the surface of photoreceptor 21. In the image forming method of the present invention, for a developer used for the developing member, a polymerized toner is preferably used. When a polymerized toner featuring a uniform shape and uniform particle size distribution is combined with an organic photoreceptor according to the present invention, an electrophotographic image exhibiting superior sharpness can be realized.

An electrostatic latent image formed on the organic photoreceptor of the present invention is visualized as a toner image via development. A toner used in development may be a pulverized toner or a polymerized toner. However, as a toner according to the present inventions a polymerized toner produced via a polymerization method is preferable from the viewpoint of realizing stable particle size distribution.

The polymerized toner refers to a toner wherein a toner binder resin is prepared and a toner shape is formed via polymerization of a raw material monomer of the binder resin, followed by chemical treatment if appropriate, more specifically referring to a toner formed via polymerization reaction such as suspension polymerization or emulsion polymerization and thereafter, if appropriate, via a process of self-fusion of particles.

Incidentally, the volume average particle diameter, namely the 50% volume particle diameter (Dv50), of the toner is preferably 2-9 μm, more preferably 3-7 μm. This range enables to enhance resolution. Further, combinations with the above range make it possible to realize a smaller particle diameter toner with a less existence amount of a minute particle diameter toner, whereby improved reproducibility of a dot image is achieved for a long-term period and a stable image exhibiting enhanced sharpness can be formed.

A toner according to the present invention may be used as a single-component developer or a two-component developer.

For use as the single-component developer, listed are a nonmagnetic single-component developer and a magnetic single-component developer wherein magnetic particles of about 0.1-0.5 μm is incorporated in a toner, and either thereof can be used.

Further, use as the two-component developer is possible by mixing with carriers. In this case, it is possible to use, as magnetic particles of the carriers, materials conventionally known in the art including metals such as iron, ferrite, or magnetite and alloys of the above metals with metals such as aluminum or lead. However, ferrite particles are specifically preferable. The volume average particle diameter of the magnetic particles is preferably 15-100 μm, more preferably 25-80 μm.

The volume average particle diameter of the carriers can be determined typically with laser diffraction type particle size distribution meter "HELOS" (produced by Sympatec Co.) equipped with a wet-type homogenizer.

As the carriers, preferable are those wherein magnetic particles are further coated with a resin or so-called resin dispersion-type carriers wherein magnetic particles are dispersed in a resin. A resin composition for coating is not specifically limited. There are used, for example, olefin resins, styrene resins, styrene-acrylic resins, silicone resins, ester resins, and fluorine-containing polymer resins. Further, as resins to constitute the resin dispersion-type carriers, any appropriate resins known in the art can be used with no specific limitation, including, for example, styrene-acrylic resins, polyester resins, fluorine resins, and phenol resins.

In transfer paper conveying section D, paper feeding units 41(A), 41(B), and 41(C) are arranged as transfer paper storing members in which sheets of transfer paper P of different size are stored in the lower part of an image forming unit, and manual paper feeding unit 42 is also arranged on the side to manually feed sheets of paper. Transfer paper P selected from any of the feeding units is fed along conveying path 40 by guide roller 43. Then, transfer paper P is temporarily stopped by a pair of paper feeding and registration rollers 44 to correct the slant or deviation of fed transfer paper P and then is re-fed, being thereafter guided into conveying path 40, pre-transfer roller 43*a*, paper feeding path 46, and entering guide plate 47. Then, a toner image on photoreceptor 21 is transferred on transfer paper P while being mounted and conveyed on transfer conveyance belt 454 of transfer conveyance belt unit 45 at transfer position Bo by transfer pole 24 and separation pole 25. Transfer paper P is then separated from the surface of photoreceptor 21 and conveyed to fixing member 50 by transfer conveyance belt unit 45.

Fixing member 50 has fixing roller 51 and pressurizing roller 52, and fixes the toner via heating and pressurization by allowing transfer paper P to pass between fixing roller 51 and pressurizing roller 52. Transfer paper P, having been subjected to toner image fixing, is discharged onto paper discharging tray 64.

Image formation on one side of transfer paper has been described above. In the case of duplex copying, paper discharge switching member 170 is switched and transfer paper guide section 177 is opened to convey transfer paper P in the dashed arrow direction.

Further, transfer paper P is conveyed downward by conveying mechanism 178 and switched back by transfer paper turnaround section 179, and then conveyed into the inside of duplex copying paper feeding unit 130 while the end portion of transfer paper P is switched to the top portion.

Transfer paper P is shifted toward the paper feeding direction through conveying guide 131 arranged in duplex copying paper feeding unit 130, and then re-fed by paper feeding roller 132 to guide transfer paper P into conveying path 40.

Transfer paper P is conveyed again toward photoreceptor 21 as described above. Then, a toner image is transferred on the rear surface of transfer paper P, followed by being fixed by fixing member 50, and then paper discharging onto paper discharging tray 64 is carried out.

The image forming apparatus of the present invention may be constituted in such a manner that components such as a photoreceptor, a developing unit, and a cleaning unit described above are combined into a unit as a process cartridge, and then this unit may be structured so as to be fully detachable to the apparatus main body. Further, it is possible to employ the following constitution: a process cartridge is formed to hold at least one of a charging unit, an image exposure unit, a developing unit, a transfer or separation unit, and a cleaning unit together with a photoreceptor as a single unit fully detachable to the apparatus main body wherein the single unit is fully detachable using a guide member such as rails of the apparatus main body.

Figure 2:
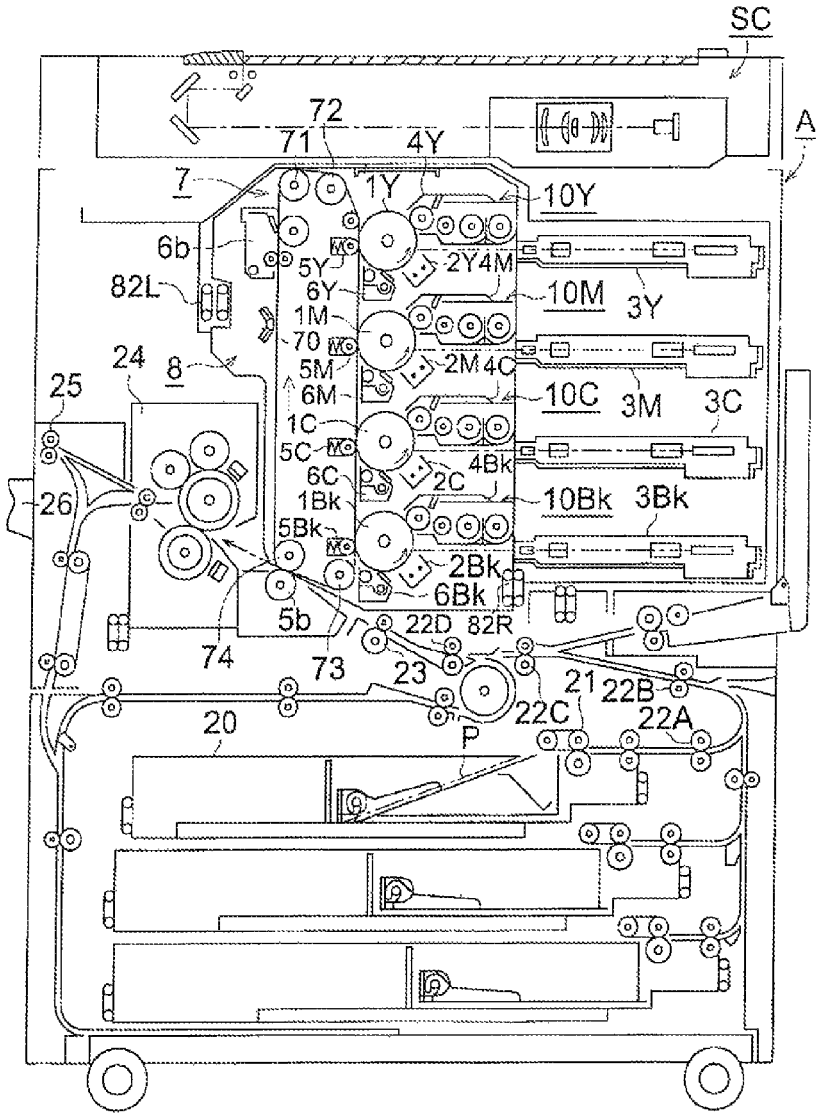
[FIG. 2] A cross-sectional constitution view of a color image forming apparatus showing one embodiment or the present invention

FIG. 2 is a cross-sectional constitution view of a color image forming apparatus showing one embodiment of the present invention.

This color image forming apparatus is referred to as a tandem-type color image forming apparatus, and composed of 4 image forming sections (image forming units) 10Y, 10M, 10C, and 10Bk; endless belt-shaped intermediate transfer body unit 7; paper feeding and conveying member 21; and fixing member 24. In the upper part of image forming apparatus main body A, original document image reading unit SC is arranged.

Image forming section 10Y, forming a yellow image, incorporates charging member (charging process) 2Y arranged around drum-shaped photoreceptor 1Y as a first image carrier, exposure member (exposure process) 3Y, developing member (developing process) 4Y, primary transfer roller 5Y as a primary transfer member (primary transfer process), and cleaning member 6Y. Image forming section 10M, forming a magenta image, incorporates drum-shaped photoreceptor 1M as a first image carrier, charging member 2M, exposure member 3M, developing member 4M, primary transfer roller 5M as a primary transfer member, and cleaning member 6M. Image forming section 10C, forming a cyan image, incorporates drum-shaped photoreceptor 1C as a first image carrier, charging member 2C, exposure member 3C, developing member 4C, primary transfer roller 5C as a primary transfer member, and cleaning member 6C. Image forming section 10Bk, forming a black image, incorporates drum-shaped photoreceptor 1Bk as a first image carrier, charging member 2Bk, exposure member 3Bk, developing member 4Bk, primary transfer roller 5Bk as a primary transfer member, and cleaning member 6Bk.

Above-mentioned 4 image forming units 10Y, 10M, 10C, and 10Bk are composed, around centrally located photoreceptor drums 1Y, 1M, 1C, and 1Bk, of rotatable charging members 2Y, 2M, 2C, and 2Bk; image exposure members 3Y, 3M, 3C, and 3Bk; rotatable developing members 4Y, 4M, 4C, and 4Bk; and cleaning members 5Y, 5M, 5C, and 5Bk to clean photoreceptor drums 1Y, 1M, 1C, and 1Bk, respectively.

Image forming units 10Y, 10M, 10C, and 10Bk, described above, each have the same constitution only with different toner image colors formed on photoreceptors 1Y, 1M, 1C, and 1Bk. Accordingly, image forming unit 10y will now be detailed as an example.

In image forming unit 10Y, around photoreceptor drum 1Y which is an image forming body, there are arranged charging member 2Y (hereinafter referred to simply as charging member 2Y or charging unit 2Y), exposure member 3Y, developing member 4Y, and cleaning member 5Y (hereinafter referred to simply as cleaning member 5Y or cleaning blade 5Y) to form a toner image of yellow (Y) on photoreceptor drum 1Y. Further, in the embodiments of the present invention, in such image forming unit 10Y, at least photoreceptor drum 1Y, charging member 2Y, developing member 4Y, and cleaning member 5Y are arranged into a single unit.

Charging member 2Y is a member to uniformly apply a potential to photoreceptor drum 1Y. In the embodiments of the present invention, corona discharge-type charging unit 2Y is used for photoreceptor drum 1Y.

Image exposure member 3Y is a member to perform exposure onto photoreceptor drum 1Y, having been provided with a uniform potential by charging unit 2Y, based on image signals (yellow) to form an electrostatic latent image corresponding to a yellow image. For such exposure member 3Y, there are used those composed of an LED wherein light-emitting elements are array-arranged in the axial direction of photoreceptor drum 1Y and an imaging element (trade name: SELFOC lens), or laser optical systems.

The image forming apparatus of the present invention may be constituted in such a manner that components such as a photoreceptor, a developing unit, and a cleaning unit described above are combined into a unit as a process cartridge (image forming unit), and then this image forming unit may be structured so as to be fully detachable to the apparatus main body. Further, it is possible to employ the following constitution: a process cartridge (image forming unit) is formed to hold at least one of a charging unit, an image exposure unit, a developing unit, a transfer or separation unit, and a cleaning unit together with a photoreceptor to form a single image forming unit fully detachable to the apparatus main body wherein the single unit is fully detachable using a guide member such as rails of the apparatus main body. Herein, "to hold together with" means that a process cartridge can be attached or removed as one body which is a process cartridge unit.

Endless belt-shaped intermediate transfer body unit 7, which is wound around a plurality of rollers, has endless belt-shaped intermediate transfer body 70 as a semiconductive endless belt-shaped second image carrier which is rotatably held.

Each of color images formed by image forming units 10Y, 10M, 10C, and 10Bk is successively transferred onto rotating endless belt-shaped intermediate transfer body 70 via primary transfer rollers 5Y, 5M, 5C, and 5Bk as primary transfer members to form a composed color image. Transfer paper P as a transfer material (a support carrying a final fixed image, for example, plain paper or a transparent sheet) loaded in paper feeding cassette 20 is fed by paper feeding member 21, and passes through a plurality of intermediate rollers 22A, 22B, 22C, and 22D, and registration roller 23, followed by being conveyed to secondary transfer roller 5*b*, serving as a secondary transfer member, whereby secondary transfer is carried out onto transfer paper P for collective transfer of several color images. Transfer paper P, on which the color images have been transferred, is subjected to fixing treatment using fixing member 24, and then is nipped by paper discharging rollers 25 and deposited on paper discharging tray 26 outside the apparatus. Herein, transfer supports of a toner image formed on a photoreceptor such as an intermediate transfer body or a transfer material are collectively referred to as transfer media.

On the other hand, the color images are transferred onto transfer paper P by secondary transfer roller 5*b* as a secondary transfer member, and thereafter the residual toner on endless belt-shaped intermediate transfer body 70, which has been curvature-separated from transfer paper P, is removed by cleaning member 6*b*.

During image forming treatment, primary transfer roller 5Bk is always in pressure contact with photoreceptor 1Bk. Other primary transfer rollers 5Y, 5M, and 5C each are brought into pressure contact with corresponding photoreceptors 1Y, 1M, and 1C only during color image formation.

Secondary transfer roller 5*b* is brought into pressure contact with endless belt-shaped intermediate transfer body 70, only when transfer paper P passes a specified position to carry out secondary transfer.

Further, chassis 8 is structured so as to be withdrawn from apparatus main body A via supporting rails 82L and 82R.

Chassis 8 is composed of image forming sections 10Y, 10M, 10C, and 10Bk, and endless belt-shaped intermediate transfer body unit 7.

Image forming sections 10Y, 10M, 10C, and 10Bk are tandemly arranged in the perpendicular direction. Endless belt-shaped intermediate transfer body unit 7 is arranged on the left side of photoreceptors 1Y, 1M, 1C, and 1Bk as shown in the drawing. Endless belt-shaped intermediate transfer body unit 7 is composed of rotatable endless belt-shaped intermediate transfer body 70 wound around rollers 71, 72, 73, and 74, primary transfer rollers 5Y, 5M, 5C, and 5Bk, and cleaning member 6*b*.

Figure 3:
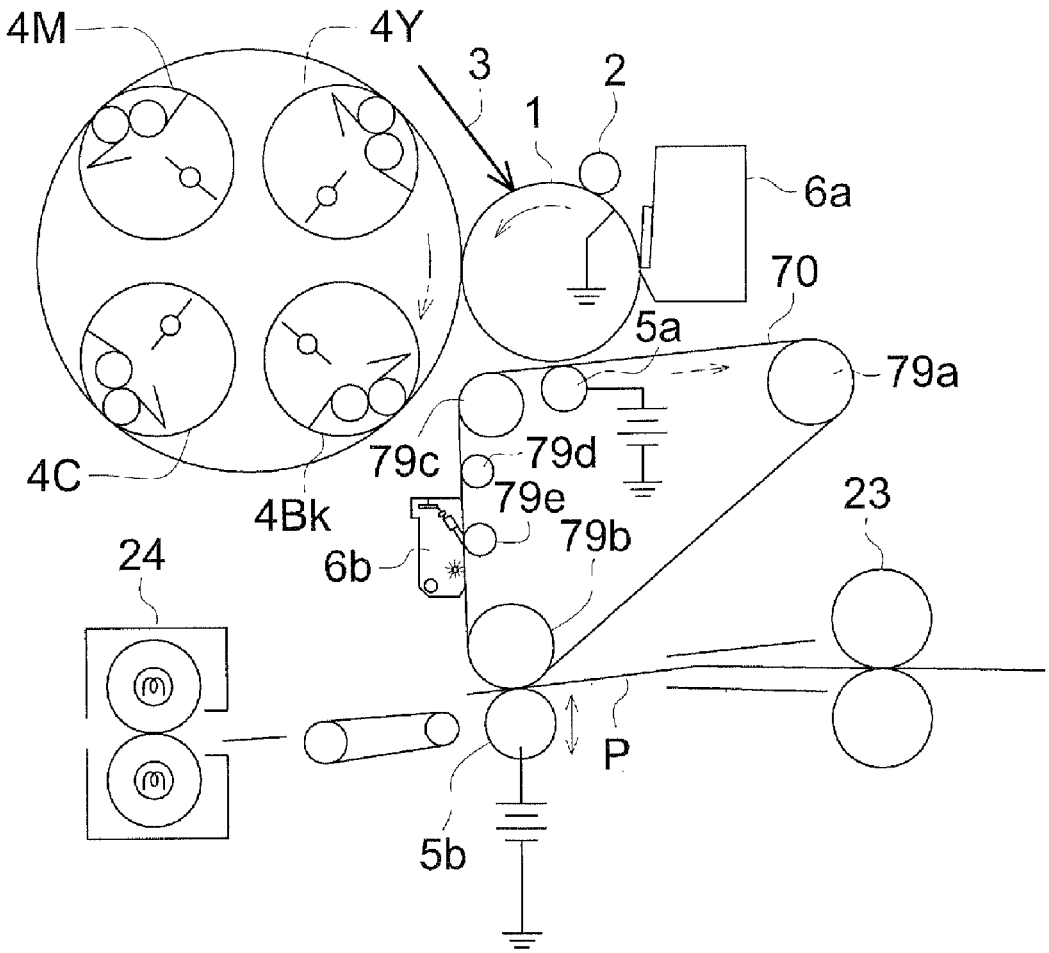
[FIG. 3] A dross-sectional constitution view of a color image forming apparatus utilizing the organic photoreceptor of the present invention

Next, FIG. 3 is a cross-sectional constitution view of a color image forming apparatus (a copier or a laser beam printer having at least a charging member, an exposure member, a plurality of developing members, a transfer member, a cleaning member, and an intermediate transfer body around an organic photoreceptor) employing the organic photoreceptor of the present invention. An elastic material of a medium resistance is used for belt-shaped intermediate transfer body 70.

Numeral 1 is a rotatable drum-type photoreceptor which is repeatedly used as an image forming body and rotationally driven at a specified peripheral rate in the counter-clockwise direction as shown by the arrow.

Photoreceptor 1 is uniformly charged during rotation at a specified polarity and potential by charging member (charging process) 2, and then is subjected to image exposure by image exposure member (image exposure process) 3 (not shown) via scanning exposure light using laser beams modulated in response to chronological electric digital pixel signals of image information to form an electrostatic latent image corresponding to a color component image (color information) of yellow (Y) of the targeted color image.

Subsequently, the resulting electrostatic latent image is developed by yellow (Y) developing member, that is, developing process (yellow developing unit) 4Y using a yellow toner which is used for a first color image. During the above operation, each of second-fourth developing members (the magenta developing unit, the cyan developing unit, and the black developing unit) 4M, 4C, and 4Bk is not operated and produces no action on photoreceptor 1, whereby the yellow toner image as the first color image is not affected by the second-fourth developing units.

Intermediate transfer body 70 is stretched around rollers 79*a*, 79*b*, 79*c*, 79*d*, and 79*e*, and rotationally driven in the clockwise direction at the same peripheral rate as photoreceptor 1.

While the yellow toner image as the first color, having been formed and carried on photoreceptor 1, passes the nip portion of photoreceptor 1 and intermediate transfer body 70, the image is successively subjected to intermediate transfer (primary transfer) onto the outer circumference surface of intermediate transfer body 70 via an electric field formed by a primary transfer bias applied to intermediate transfer body 70 from primary transfer roller 5*a*.

The surface of photoreceptor 1, having completed the transfer of the yellow toner image as the first color corresponding to intermediate transfer body 70, is cleaned by cleaning unit 6*a*.

Thereafter, in the same manner as above, a magenta toner image as a second color, a cyan toner image as a third color, and a black toner image as a fourth color are successively transferred onto intermediate transfer body 70 in a superposed manner to form a superposed color toner image corresponding to the targeted color image.

Secondary transfer roller 5*b* is subjected to bearing in parallel to secondary transfer facing roller 79*b* and is arranged in the bottom surface part of intermediate transfer body 70 so as to be withdrawn.

A primary transfer bias to carry out successive superposing transfer of toner images of the first-fourth colors onto intermediate transfer body 70 from photoreceptor 1 exhibits polarity opposite to that of the toner and is applied from a bias power source. The applied voltage is, for example, in the range of +100 V to +2 kV.

During the primary transfer process of toner images of the first-third colors from photoreceptor 1 to intermediate transfer body 70, secondary transfer roller 5*b* and intermediate transfer body cleaning member 6*b* may be withdrawn from intermediate transfer body 70.

Transfer of the superposed color toner image, having been transferred onto belt-shaped intermediate transfer body 70, onto transfer paper P as a second image carrier is carried out in such a manner that secondary transfer roller 5*b* is brought into pressure contact with the belt of intermediate transfer body 70 and transfer paper P is fed at specified timing to the contact nip between the belt of intermediate transfer body 70 and secondary transfer roller 5*b* through a transfer paper guide from paired paper feeding registration rollers 23. A secondary transfer bias is applied to secondary transfer roller 5*b* from a bias power source. The superposed color toner image is transferred (secondary transfer) by this secondary transfer bias onto transfer paper P, which is a second image carrier, from intermediate transfer body 70. Transfer paper P, which has been subjected to the transfer of the toner image, is conveyed to fixing member 24 for thermal fixing.

The image forming apparatus of the present invention is applied to common electrophotographic apparatuses such as electrophotographic copiers, laser printers, LED printers, or liquid crystal shutter-type printers. In addition, it is possible to find wide applications in display, recording, short-run printing, plate making, and apparatuses such as facsimile machines to which electrophotographic technology is applied.

EXAMPLES

The present invention will now be detailed with reference to examples, but the embodiments of the present invention are not limited thereto. Incidentally, "part" referred to in the following sentences represents "part by mass."

Production of Photoreceptor 1

Photoreceptor 1 was produced in the following manner.

The surface of a cylindrical aluminum support was subjected to cutting work to prepare a conductive support of surface roughness Rz=1.5 μm.

<Intermediate Layer>

A dispersion of the following composition described below was two-fold diluted with the same mixed solvent as for the dispersion and allowed to stand overnight, followed by filtration (filter: RIGIMESH 5 μm filter, produced by Nihon Pall Ltd.) to prepare an intermediate layer coating liquid.

| | |
|---|---|
| Polyamide resin CM8000 (produced by Toray Industries, Inc.) | 1 part |
| Titanium oxide SMT500SAS (produced by Tayca Corp.) | 3 parts |
| Methanol | 10 parts |

A sand mill was used as a homogenizer to carry out batch dispersion for 10 hours.

This coating liquid was coated on the above support via an immersion coating method at a dry film thickness of 2 μm.

<Charge Generating Layer>

| | |
|---|---|
| Charge generating material: titanylphthalocyanine pigment (a titanylphthalocyanine pigment having a maximum diffraction peak at least at a position of 27.3° based on Cu-Kα characteristic X-ray diffraction spectrum determination) | 20 parts |
| Polyvinyl butyral resin (#6000-C, produced by Denki Kagaku Kogyo KK) | 10 parts |
| t-Butyl acetate | 700 parts |
| 4-Methoxy-4-methyl-2-pentanone | 300 parts |

The above compositions were mixed and dispersed using a sand mill for 10 hours to prepare a charge generating layer coating liquid. This coating liquid was coated on the above intermediate layer via an immersion coating method to form a charge generating layer of a dry film thickness of 0.3 μm.

<Charge Transporting Layer>

| | |
|---|---|
| Charge transporting material (CTM) (CTM-1) | 225 parts |
| Binder: polycarbonate (Z300, produced by Mitsubishi Gas Chemical Company, Inc.) | 300 parts |
| Antioxidant (Irganox1010, produced by Nihon Ciba-Geigy KK) | 6 parts |
| Dichloromethane | 2,000 parts |
| Silicone oil (KF-54, Shin-Etsu Chemical Co., Ltd.) | 1 part |

The above compositions were mixed and dissolved to prepare a charge transporting layer coating liquid. This coating liquid was coated on the above-prepared charge generating layer using a circular slide hopper coater to form a charge transporting layer of a dry film thickness of 20 μm.

<Protective Layer>

| | |
|---|---|
| Metal oxide particle (titanium oxide of a number average particle diameter of 15 nm and a moisture absorption ratio of 0.1%) | 10 parts |
| Compound having a radical polymerizable, curable functional group (Exemplified Compound No. 7) | 20 parts |
| Polymerization initiator (combination use of 1-2/1-5 = 0.5 part/0.5 part) | 1 part |
| Isopropyl alcohol | 50 parts |

The above compositions were mixed while stirring for sufficient dissolution and dispersion to produce a protective layer coating liquid. Using this coating liquid, a protective layer was coated on the photoreceptor, having been previously produced up to the charge transporting layer, by use of a circular slide hopper coater. After coating, drying was carried out at 90° C. for 20 minutes (solvent drying process), followed by UV irradiation for 1 minute using a low pressure mercury lamp (UV curing process) to obtain a protective layer of a dry film thickness of 5.0 μm.

Production of Photoreceptors 2-16

Photoreceptors 2-16 were produced in the same manner as for photoreceptor 1 except that a CTM for the charge transporting layer and a curable compound, a metal oxide particle, and a photopolymerization initiator for the protective layer were changed as shown in following Table 1.

TABLE 1

| Photo-receptor | Protective Layer: Curable Functional Group-containing Compound Exemplified | Polymerization Initiator (amount: part) | | | Metal Oxide Particle (particle diameter (nm), amount (part)) | | Coating | Charge Transporting Layer | | N's Atomic Weight Ratio | |
|---|---|---|---|---|---|---|---|---|---|---|---|
| No. | Compound No. | Initiator 1 | Initiator 2 | Initiator 3 | Type | Solvent | Method | *5 | *6 | (%) | Remarks |
| 1 | (7) | 1-1/1-5 (0.5/0.5) | | | *1 | n-PrOH | CSH | CTM-1 | 744 | 3.76 | ** |
| 2 | (6) | | 2-1 (1.0) | | *1 | n-PrOH | CSH | CTM-2 | 505 | 2.77 | ** |
| 3 | (6) | 1-1/1-6 (0.3/0.5) | 2-2 (0.2) | | *2 | 2-PrOH | CSH | CTM-3 | 685 | 2.04 | ** |
| 4 | (6) | 1-1/1-5 (0.5/0.5) | | | *3 | n-BuOH | CSH | CTM-2 | 505 | 2.77 | ** |
| 5 | (9) | | | 3-1 (0.5) | *2 | n-PrOH | spray | CTM-4 | 451 | 3.10 | ** |
| 6 | (33) | 1-6 (0.5) | 2-1 (0.5) | | none | n-PrOH | CSH | CTM-3 | 685 | 2.04 | ** |
| 7 | (41) | 1-4 (0.7) | | | *1 | n-PrOH | spray | CTM-5 | 699 | 2.50 | ** |
| 8 | *4 | 1-1 (0.2) | 2-6 (0.3) | 3-1 (0.5) | *1 | n-PrOH | CSH | CTM-6 | 1057 | 2.65 | ** |
| 9 | *4 | 1-1 (0.2) | 2-1 (0.3) | 3-2 (0.5) | *1 | n-PrOH | CSH | CTM-7 | 315 | 4.44 | ** |
| 10 | (6) | 1-3 (0.5) | | | none | n-PrOH | CSH | CTM-8 | 544 | 5.14 | ** |
| 11 | (6) | 1-5 (0.5) | 2-6 (0.5) | | *1 | n-PrOH | CSH | CTM-8 | 544 | 5.14 | ** |
| 12 | (6) | | 2-1 (0.5) | 3-2 (0.5) | *1 | n-PrOH | CSH | CTM-9 | 287 | 4.87 | ** |
| 13 | (6) | 1-1 (0.5) | 2-6 (0.5) | | *1 | MIBK | CSH | CTM-8 | 544 | 5.14 | Comp. |
| 14 | (6) | 1-1 (1.0) | | | *2 | n-PrOH/MEK 1/1 | CSH | CTM-9 | 287 | 4.87 | Comp. |
| 15 | (7) | 1-1 (0.3) | 2-1 (0.2) | 3-2 (0.5) | *2 | MEK | CSH | CTM-8 | 544 | 5.14 | Comp. |
| 16 | (6) | 1-1 (1.0) | | | *1 | n-PrOH/MEK 1/1 | CSH | CTM-9 | 287 | 4.87 | Comp. |

*1: titanium oxide (15, 60),
*2: titanium oxide (15, 50),
*3: zinc oxide (35, 60),
*4: 1:1 combined use of (8) and (41),
*5: Charge Transporting Material
*6: Molecular Weight,
**: example,
Comp.: comparative example In Table 1, n-PrOH, n-BuOH, MIBK, and MEK refer to n-propyl alcohol, n-butyl alcohol, methyl isobutyl ketone, and methyl ethyl ketone, respectively. Further, with regard to each of titanium oxide and zinc oxide listed in Table 1, those, surface-treated via hydrophobization using a reactive organic silicon compound, were used.

[Photoreceptor Evaluation]

The thus-produced photoreceptors were evaluated as follows.

"Surface Scratches"

For photoreceptor evaluation, bizhub C250Color (a tandem-type color multifunction peripheral featuring laser exposure, reverse development, and an intermediate transfer body) (produced by Konica Minolta Business Technologies, Inc.) was modified, and then a photoreceptor was mounted on this evaluation model with an appropriate exposure amount. The initial charge potential was set at −450 V. Thereafter, under an ambience of high temperature and humidity (30° C. and 80% RH), a halftone image of cyan color of a printing rate of 50% was printed, prior to and after printing output of 1000 sheets with respect to an A4 full-color image (a figure image in the background of a colorful amusement part). The halftone image was visually evaluated based on the following criteria.

A: No surface scratch even after 1,000-sheet printing (excellent)

B: Occurrence of 1-2 surface scratches after 1,000-sheet printing (practically unproblematic)

C: Occurrence of at least 3 surface scratches prior to 1,000-sheet printing (practically problematic)

"Image Deletion"

Similarly to surface scratches, image deletion was evaluated based on the following criteria, prior to and after, as well as in the mid-course of full-color image printing output of 1,000 sheets.

A: No image deletion even after 1,000-sheet printing (excellent)

B: No image deletion even after 500-sheet printing (practically unproblematic)

C: Image deletion occurrence prior to 500-sheet printing (practically problematic)

"Center Detect Evaluation"

Evaluation was carried out based on a lattice pattern image of cyan color prior to and after the above full-color printing output of 1,000 sheets.

The evaluation criteria are as follows:

A: No center defect occurs at all (excellent).

B: A slight center defect occurs, being visually observable slightly with the naked eye (practically unproblematic).

C: A center defect occurs, being definitely observable with the naked eye (practically problematic).

"Image Density"

In the evaluation of surface scratches, the above-mentioned 1,000 sheets were changed to 10,000 sheets and then evaluation was carried out based on the density difference in solid cyan images prior to and after output of these sheets. Image density was evaluated based on the density difference between "at the printing initiation" and "at the printing of the 10,000th sheet", wherein the density of the solid cyan image was measured using RD-918. (produced by Macbeth Co.) as a relative reflection density to a paper reflection density designated as "0."

The evaluation criteria are as follows:

A: Density difference is less than 0.1 (excellent due to minimal variation of image density).

B: Density difference is 0.1-0.15 (exhibiting practicality).

C: Density difference is at least 0.15 (problematic due to large variation of image density).

"Fog"

Using Macbeth Reflective Densitometer "RD-918," the density of non-printed copy paper (white paper) was measured at 20 locations as absolute image densities, and then the average value thereof was designated as the white paper density. Subsequently, for image density evaluation, white-ground portions of an image-formed cyan image were similarly measured at 20 locations as absolute densities, and then a value obtained by subtracting the above white paper density from the average density thereof was evaluated as the fog density.

A: At most 0.005 (excellent)

B: 0.005-0.01 (practically unproblematic)

C: More than 0.01 (practically problematic obviously)

Potential Characteristics Evaluation

In the above evaluation using bizhub C250, potential characteristics were evaluated using a photoreceptor of the image forming unit of cyan color. The initial charge potential was set at −450V. Thereafter, under an ambience of high temperature and humidity (30° C. and 80% RH), using an A4 full-color image (a figure image in the background of a colorful amusement part), processes such as charging and exposing were repeated for 1000 sheets (the developing unit was removed and a potential measurement probe was arranged at the original position of the developing unit), and then the charge potential (VH) of the white-ground portion and the potential (VL) of the solid image were measured. Thereafter, evaluation was carried out based on the varied amount (ΔVH) of VH and the varied amount (ΔVL) of VL at the printing initiation and after the printing of 1000 sheets.

A: ΔVH is at most 15 V and ΔVL is at most 20V (excellent).

B: ΔVH is at most 30 V and ΔVL is at most 40V (practically unproblematic),

C: ΔVH is at least 31 V or ΔVL is at least 41V (practically problematic obviously).

TABLE 2

| Photo-receptor No. | Polymerization Initiator Content in Photosensitive Layer (ppm) | Tac/ Tcb × 100 | Surface Scratch | Image Deletion | Center Defect | Image Density | Fog | Potential Characteristics | Remarks |
|---|---|---|---|---|---|---|---|---|---|
| 1 | 4000 | 4.7 | A | B | A | A | A | A | example |
| 2 | 3000 | 8.0 | B | B | A | A | A | A | example |
| 3 | 4500 | 3.5 | A | A | A | A | A | A | example |
| 4 | 4900 | 2.0 | A | A | A | A | A | A | example |
| 5 | 680 | 8.0 | B | B | A | A | A | A | example |
| 6 | 920 | 5.0 | A | A | A | A | A | A | example |
| 7 | 1200 | 8.5 | B | B | A | A | A | A | example |
| 8 | 2600 | 6.2 | B | A | A | A | A | A | example |
| 9 | 4800 | 5.5 | B | B | A | A | A | A | example |
| 10 | 500 | 9.3 | B | B | A | A | A | A | example |
| 11 | 1000 | 3.1 | A | A | A | A | A | A | example |
| 12 | 3000 | 4.6 | B | A | A | A | A | A | example |
| 13 | 8000 | 50.0 | C | C | B | C | B | B | comparative example |
| 14 | 6500 | 24.0 | B | B | B | C | B | B | comparative example |
| 15 | 9000 | 45.0 | C | C | B | C | B | B | comparative example |
| 16 | 6000 | 36.0 | B | B | B | C | B | B | comparative example |

Table 2 shows that the protective layer of the present invention is a surface layer obtained via reaction curing of a radical polymerizable/curable functional group using a polymerization initiator, and photoreceptors 1-12, having a structure wherein the content of the polymerization initiator detected in the above photosensitive layer is at most 5,000 ppm, produced the excellent results for all the evaluation items; but photoreceptors 13-16 (a solvent such as MIBK or MEK tending to swell a photosensitive layer is used) having a content of more than 5,000 ppm of the polymerization initiator detected in the photosensitive layer of each of the comparative examples were evaluated to be practically insufficient with regard to some of the evaluation items.

DESCRIPTION OF THE SYMBOLS

10Y, 10M, 10C, and 10Bk: image forming units
1Y, 1M, 1C, and 1Bk: photoreceptors
2Y, 2M, 2C, and 2Bk: charging members
3Y, 3M, 3C, and 3Bk: exposure members
4Y, 4M, 4C, and 4Bk: developing members

What is claimed is:

1. An organic photoreceptor comprising a photosensitive layer on a conductive substrate and a protective layer on the photosensitive layer, wherein the protective layer is a surface layer prepared via reaction curing of a compound having a radical polymerizable, curable functional group using a polymerization initiator, and the content of the polymerization initiator detected in the photosensitive layer is at most 5,000 ppm.

2. The organic photoreceptor described in claim 1, wherein the polymerization initiator has an α-aminoacetophenone structure.

3. The organic photoreceptor described in claim 1, wherein the polymerization initiator has an α-hydroxyacetophenone structure.

4. The organic photoreceptor described in claim 1, wherein the polymerization initiator has an acylphosphine oxide structure.

5. The organic photoreceptor described in claim 1, wherein an added amount of the polymerization initiator is 1/10-1/1,000 weight % based on the total weight of the compound having a radical polymerizable, curable functional group.

6. The organic photoreceptor described in claim 1, wherein a curable functional group of the compound having a radical polymerizable, curable functional group is an acryloyloxy group, a methacryloyloxy group, or an epoxy group.

7. The organic photoreceptor described in claim 1, wherein an alcohol-based solvent is employed as a coating solvent of the compound having radical polymerizable, curable functional group.

8. The organic photoreceptor described in claim 1, wherein in an infrared absorption spectrum of the protective layer, a ratio of a transmittance (Tac) of a peak present in the range of 1,610 $cm^{-1}$-1,640 $cm^{-1}$ to a transmittance (Tcb) of a peak present in the range of 1,700 $cm^{-1}$-1,800 $cm^{-1}$ satisfies following Expression 1:

$$0 \leqq Tac/Tcb \times 100 \leqq 10 \quad \text{(Expression 1).}$$

9. A color image forming apparatus utilizing the organic photoreceptor described in claim 1.

10. An image forming apparatus having at least a charging member, an exposure member, and a developing member around the organic photoreceptor and carrying out repetitive image formation, wherein the organic photoreceptor is an organic photoreceptor having a photosensitive layer on a conductive substrate and a protective layer on the photosensitive layer; the protective layer is a surface layer prepared via reaction curing of a compound having a radical polymerizable, curable functional group using a polymerization initiator; and the content of the polymerization initiator detected in the photosensitive layer is at most 5,000 ppm.

11. A process cartridge forming a cartridge by holding at least one of a charging member, a developing member, and a cleaning member together with an organic photoreceptor to form a single cartridge fully detachable to an image forming apparatus body, wherein the organic photoreceptor is an organic photoreceptor having a photosensitive layer on a conductive substrate and a protective layer on the photosensitive layer; the protective layer is a surface layer prepared via reaction curing of a compound having a radical polymerizable, curable functional group using a polymerization initiator; and the content of the polymerization initiator detected in the photosensitive layer is at most 5,000 ppm.

* * * * *